US006431032B1

(12) United States Patent
Kuryan et al.

(10) Patent No.: US 6,431,032 B1
(45) Date of Patent: Aug. 13, 2002

(54) ALEX WRENCH

(76) Inventors: Armen Kuryan; Srbui Charlette Kuryan-Badivian, both of 1118 E. Raleigh St., Glendale, CA (US) 91205

( * ) Notice: Subject to any disclaimer, the term of this patent is extended or adjusted under 35 U.S.C. 154(b) by 0 days.

(21) Appl. No.: 09/738,185

(22) Filed: Dec. 15, 2000

(51) Int. Cl.[7] ..... B25B 13/52
(52) U.S. Cl. ..... 81/64; 81/3.43
(58) Field of Search ..... 81/3.43, 64

(56) References Cited

U.S. PATENT DOCUMENTS 3,269,226 A * 8/1966 Von Tersch ..... 81/64
4,964,330 A * 10/1990 Swimney et al. ..... 81/64
5,056,383 A * 10/1991 Halpin ..... 81/3.43
5,307,712 A * 5/1994 Pratt ..... 81/64
5,309,797 A * 5/1994 Nguyen ..... 81/64
5,440,955 A * 8/1995 Freeland ..... 81/64
5,458,027 A * 10/1995 Rambin ..... 81/64
5,845,550 A * 12/1998 Edwards ..... 81/64 X
6,101,903 A * 8/2000 Negley et al. ..... 81/64

* cited by examiner

*Primary Examiner*—James G. Smith
(74) *Attorney, Agent, or Firm*—Raymond Y. Chan; David and Raymond Patent Group

(57) ABSTRACT

A new and improved type of oil filter wrench consisting of a handle and a sharp toothed coil with a self adjusting band. The coil with the attached self-adjusting band has vertical and horizontal insert slots where the handle portion is inserted. The wrench after preferred assemble is secured onto the filter with effortless twist. The toothed coil then grasps the filter and the self adjusting band secures itself to the size of the oil filter making the installation or removal very easy and quick.

20 Claims, 4 Drawing Sheets

ALEX WRENCH

CROSS-REFERENCES TO RELATED APPLICATIONS

In pursuing a patent for the oil filter wrench named "Alex Wrench", our search was to locate United State patents disclosing an oil filter wrench. To a reasonable extent, the search was expanded to encompass other possible modifications and enhancements to both functional and ornamental features of the invention, thereby to hopefully provide a broad indication of the current state of art.

As illustrated in the drawings the, "Alex Wrench" is completely different. It wraps and secures itself around the oil filter and any round object by a mere turn. It does not require any bolts, hinges, etc. . . . It simply grasps and unscrews without needing unnecessary space or effort.

STATEMENT REGARDING FEDERALLY SPONSORED RESEARCH OR DEVELOPMENT

Not Applicable

REFERENCE TO A "MICROFICHE APPENDIX"

Enclosed are United States patents, which are similar or at least relevant to the functional and/or design features of the "Alex Wrench".

U.S. Pat. No. 5,388,485

Inventor(s): Auble

U.S. Pat. No. 5,065,648

Inventor(s): Hocfbaum, Jr.

U.S. Pat. No. 4,266,452

Inventor(s): Crist

U.S. Pat. No. 4,896,570

Inventor(s): Bourgeois

U.S. Pat. No. 5,090,274

Inventor(s): Schaub

U.S. Pat. No. 348,814

Inventor(s): Pearson

BACKGROUND OF THE INVENTION

TECHNICAL FIELD OF THE INVENTION

The invention relates to wrenches and tools specially designed to assist in motor vehicle maintenance and more specifically for the removal and replacement of oil filters.

BACKGROUND OF THE INVENTION

The hardest part of changing oil in an engine is manipulating the oil filter in either installing it or removing it in limited space, unknown positioning and slippery condition. To make matters worse is the old oil filter may sometimes be stuck and reaching it with a wrench in such limited space is almost impossible, causing many mechanics to be discouraged.

For these reasons, the art has included several proposals for various wrenches which can be used to manipulate an oil filter in an engine. Although these wrenches may work, there are great drawbacks in making the removal or installation difficult.

For example, some wrenches require screw adjustments, cloth coverings and loop adjustments all in very tight space. They do not facilitate the problems of stuck oil filters, slippery, out positioned filters and removal without damaging the filter. Other complication may include the requirement of great strength and agility by the manipulator. Not everyone is a professional with great strength, agility, and understanding of oil filter removal and installation.

Therefore, there is a need for a wrench that is not complicated, easy to secure, does not damage the oil filter, performs in limited space, and can be manipulated by even the weakest individual who is a novice.

BRIEF SUMMARY OF THE INVENTION

The Alex Wrench is an oil filter wrench used primarily for automobile oil filters. It consists of two main parts—the wrench section and a handle. The wrench section itself is similar to that of standard oil filter wenches presently on the market. This section would consist of an adjustable band with a diameter approximating that of standard engine oil filters. The handle section, however, would be completely different. It would be formed from a relatively small diameter steel rod and extend upward for approximately 7 inches in a "u-shaped" configuration instead of extending outward in a horizontal orientation. Thus; an individual would be provided with a substantial increase in leverage as compared to the wrenches now used.

In use, the band would be slipped over the oil filter, self-tightening itself securely and with a slight turn, using the "U-shaped" handle, unscrewing the oil filter.

The "Alex Wrench" is an ideal tool for automotive technicians and "do-it-yourselfers". Simplification features include:

1) It does not slip when oil is present on the surface of the oil filter
2) It does not require the user to occupy two hands in manipulating the device
3) It can be used for both installing and removing an oil filter
4) It does not puncture weaken or deform oil filter when using the "Alex Wrench".

Appealing aspects are its shape, optimum size, light-weight, ease of use and method of unscrewing any round object approximately the size of a standard oil filter.

BRIEF DESCRIPTION OF THE SEVERAL VIEWS OF THE DRAWING

DRAWINGS

Figure 1B:
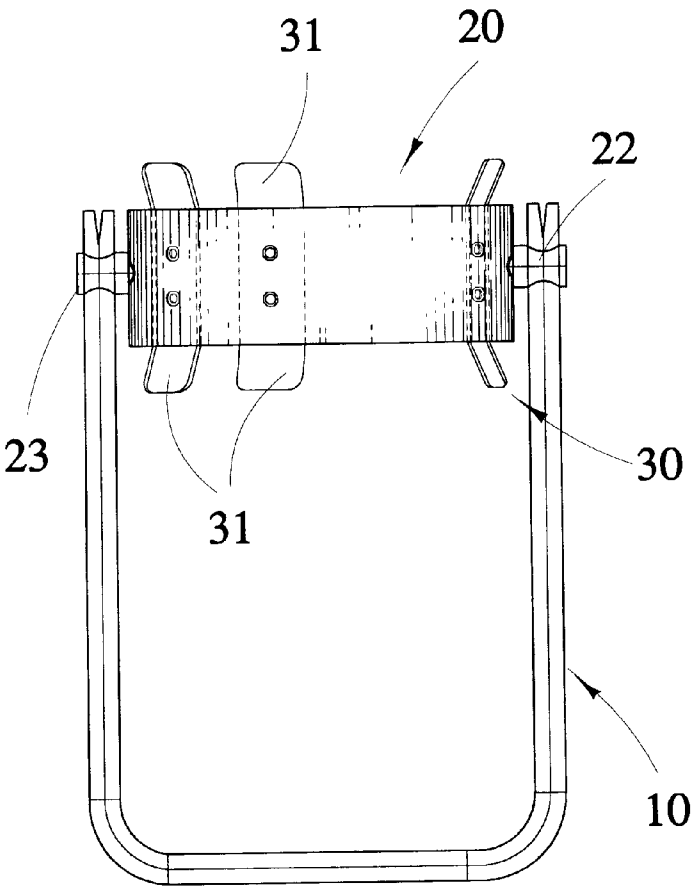
Figure 1A:
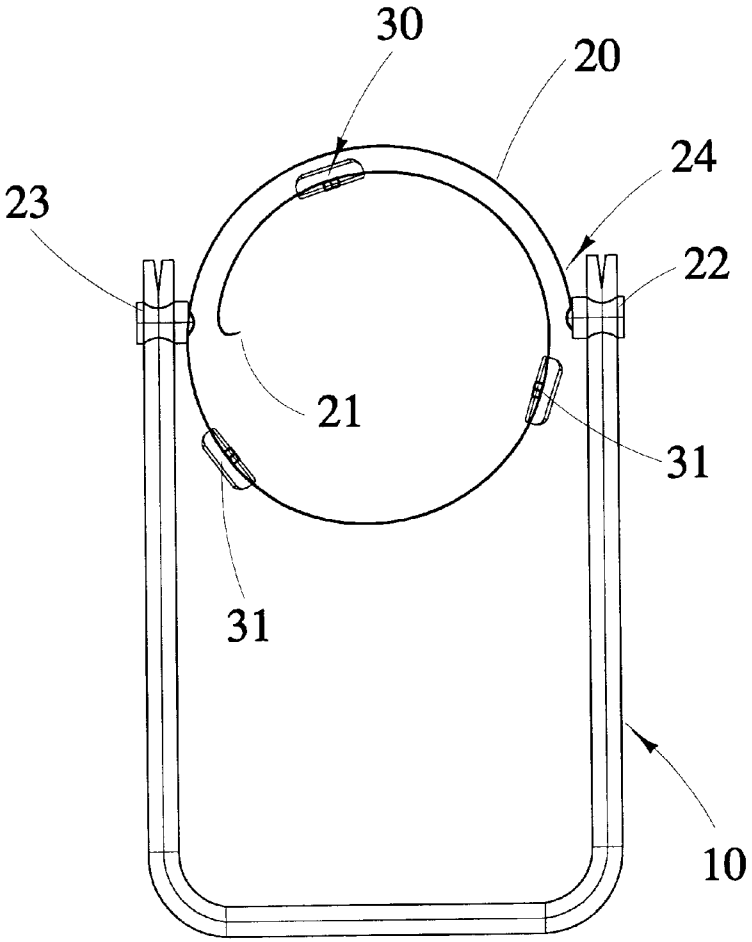
Figure 2:
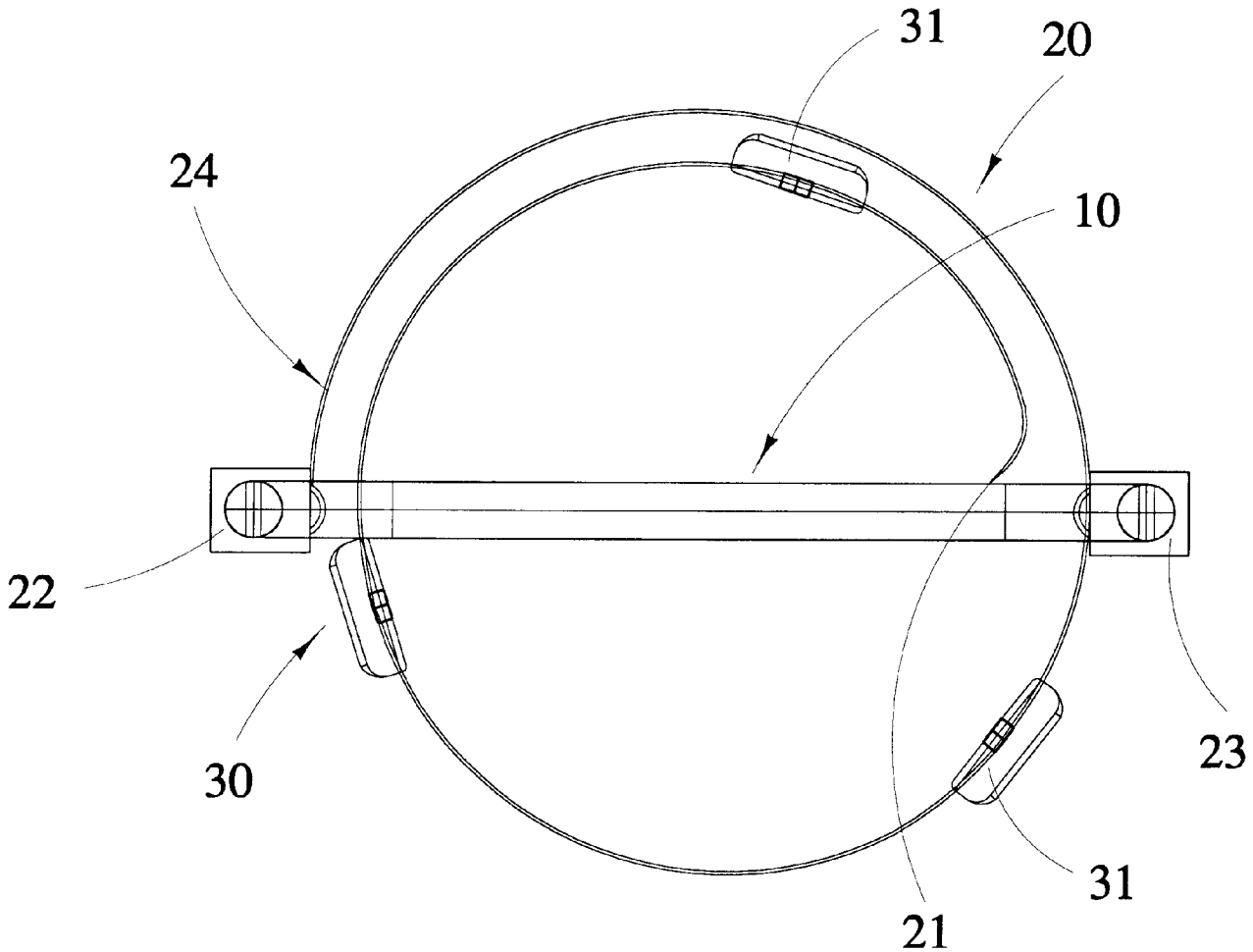
Figure 3B:
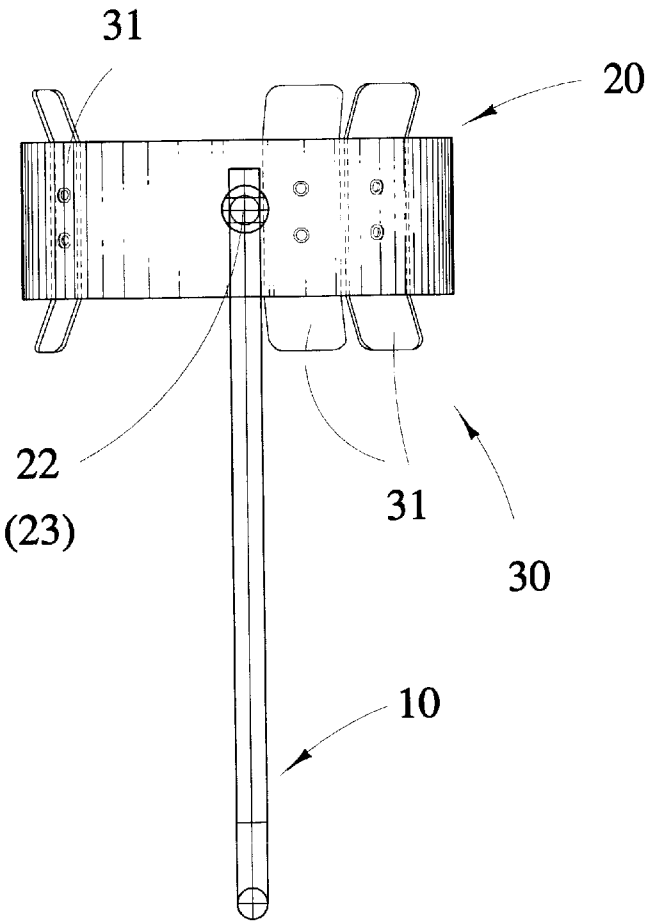
Figure 3A:
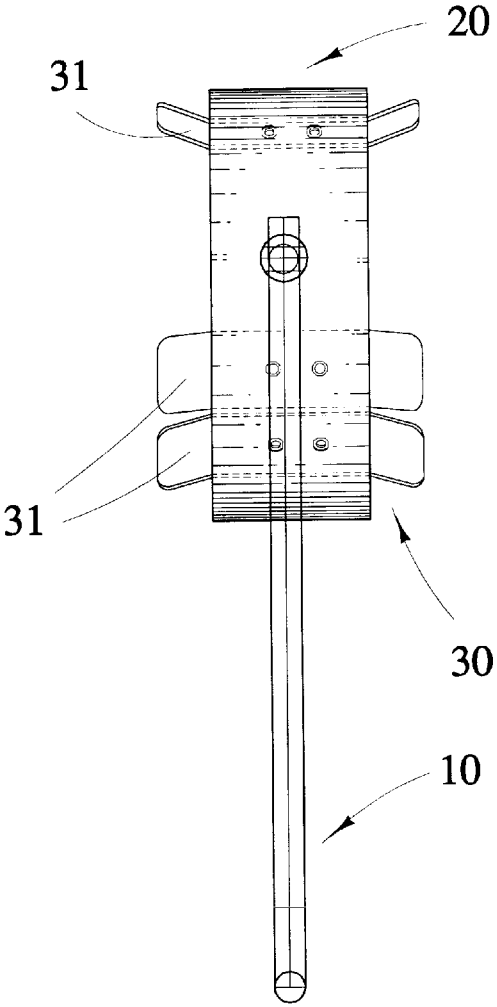
Figure 4A:
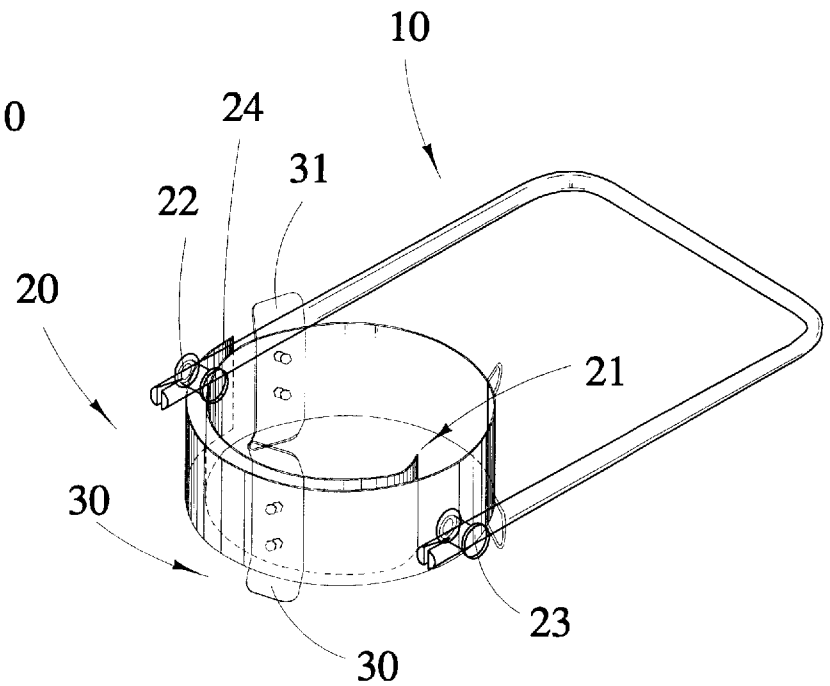
Figure 4B:
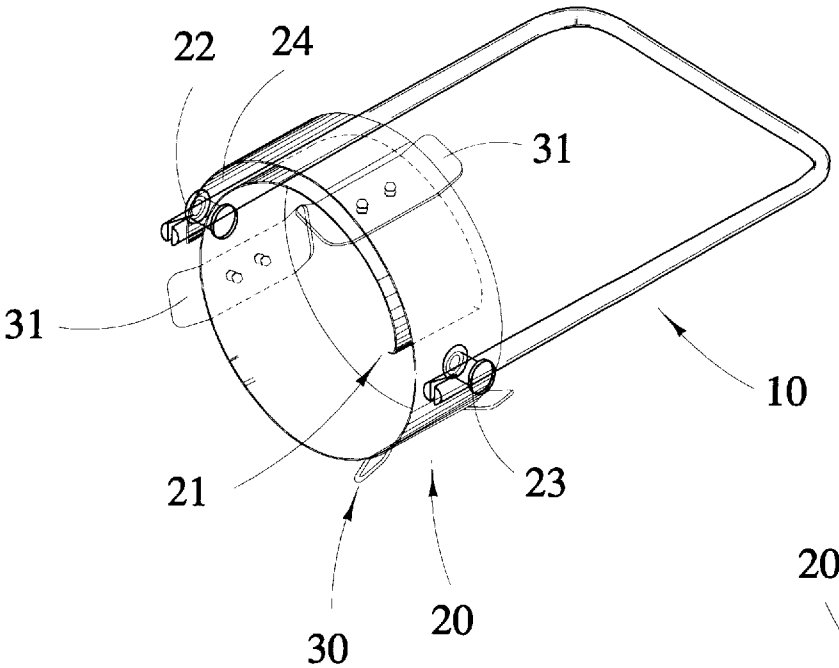

Drawing #1 is a front view of the Alex Wrench The handle portion of the invention is made of a round metal approximately 5⁹⁄₁₆ inches in height, 0.25 inches in width. The diameter across is approximately 4 inches.

Drawing #2 is an upright view of the coil. It is approximately 3.5 inches in diameter. It has an in-turning toothed end, out-turning end for size variance with an attachment approximately 0.11 inches in width to hold the self adjusting band and two exterior handle holes approximately 0.25 inches in diameter each.

Drawing #3 is the adjustable band. It is a band which is inserted around the coil. It is approximately 0.75 inches wide and 5.5 inches in length. It has two holes at each end approximately 0.25 inches in diameter.

Drawing #4 is a front view of the handle as described above with the self adjusting band attached.

DETAILED DESCRIPTION OF THE INVENTION

The "Alex Wrench" is an oil filter wrench which has two main parts, a handle and an adjustable coil.

1) The handle portion as shown in drawing #1 is a small metal frame which is easily inserted into the adjustable coil portion either vertically or horizontally.

2) The coil portion is self adjusting with metal teeth in the internal part. See drawing #3

3) It has side pockets where the handle is inserted either horizontally or vertically. With a simple turn the adjustable coil wraps around the round oil filter gripping it with its teeth and is ready to install or remove. See drawing #4

What is claimed is:

1. An oil filter wrench, comprising:

a wrench coil body having an in-turning toothed end and an out-turning end;

a pair of side pocket members affixed to two opposing sides of said wrench coil body; and a U-shaped handle having two ends respectively connected to the two side pocket members in such a manner that said handle is selectively positioned parallelly to a center axis of said wrench coil body and positioned perpendicularly with said center axis of said wrench coil body so as to increase a leverage of turning said wrench coil body with said handle.

2. An oil filter wrench, as recited in claim 1, wherein one of said side pocket members is affixed to said out-turning end of said wrench coil body while said other side pocket member is affixed to a middle portion of said wrench coil body.

3. An oil filter wrench, as recited in claim 1, wherein said two side pocket members are affixed to said wrench coil body in a rotatable manner.

4. An oil filter wrench, as recited in claim 2, wherein said two side pocket members are affixed to said wrench coil body in a rotatable manner.

5. An oil filter wrench, as recited in claim 1, wherein each of said side pocket members has a handle hole and said two ends of said handle are inserted into said two handle holes of said side pocket members respectively so as to connect said handle with said wrench coil body.

6. An oil filter wrench, as recited in claim 2, wherein each of said side pocket members has a handle hole and said two ends of said handle are inserted into said two handle holes of said side pocket members respectively so as to connect said handle with said wrench coil body.

7. An oil filter wrench, as recited in claim 3, wherein each of said side pocket members has a handle hole and said two ends of said handle are inserted into said two handle holes of said side pocket members respectively so as to connect said handle with said wrench coil body.

8. An oil filter wrench, as recited in claim 4, wherein each of said side pocket members has a handle hole and said two ends of said handle are inserted into said two handle holes of said side pocket members respectively so as to connect said handle with said wrench coil body.

9. An oil filter wrench, as recited in claim 1, further comprising a self-adjusting band attached around said wrench coil body for securing said wrench coil body on different sized oil filters.

10. An oil filter wrench, as recited in claim 9, wherein said self-adjusting band comprises a plurality of band holders spacedly attached to said wrench coil body.

11. An oil filter wrench, as recited in claim 2, further comprising a self-adjusting band attached around said wrench coil body for securing said wrench coil body on different sized oil filters.

12. An oil filter wrench, as recited in claim 11, wherein said self-adjusting band comprises a plurality of band holders spacedly attached to said wrench coil body.

13. An oil filter wrench, as recited in claim 3, further comprising a self-adjusting band attached around said wrench coil body for securing said wrench coil body on different sized oil filters.

14. An oil filter wrench, as recited in claim 13, wherein said self-adjusting band comprises a plurality of band holders spacedly attached to said wrench coil body.

15. An oil filter wrench, as recited in claim 4, further comprising a self-adjusting band attached around said wrench coil body for securing said wrench coil body on different sized oil filters.

16. An oil filter wrench, as recited in claim 15, wherein said self-adjusting band comprises a plurality of band holders spacedly attached to said wrench coil body.

17. An oil filter wrench, as recited in claim 7, further comprising a self-adjusting band attached around said wrench coil body for securing said wrench coil body on different sized oil filters.

18. An oil filter wrench, as recited in claim 17, wherein said self-adjusting band comprises a plurality of band holders spacedly attached to said wrench coil body.

19. An oil filter wrench, as recited in claim 8, further comprising a self-adjusting band attached around said wrench coil body for securing said wrench coil body on different sized oil filters.

20. An oil filter wrench, as recited in claim 19, wherein said self-adjusting band comprises a plurality of band holders spacedly attached to said wrench coil body.

* * * * *